5/29/84 OR 4,450,931

United States Patent [19]

Yamashita et al.

[11] 4,450,931

[45] May 29, 1984

[54] STRUCTURE FOR DECREASING LOW FREQUENCY AIR VIBRATION

[75] Inventors: Mitsuyasu Yamashita, Tokyo; Hiroshi Igarashi, Nagoya; Shosuke Koga, Owariasahi, all of Japan

[73] Assignees: NGK Insulators, Ltd.; Kobayashi Institute of Physical Research, both of Japan

[21] Appl. No.: 352,527

[22] Filed: Feb. 26, 1982

[30] Foreign Application Priority Data

Mar. 9, 1981 [JP] Japan ..... 56-32409

[51] Int. Cl.[3] ..... A47B 81/06; G10K 11/00

[52] U.S. Cl. ..... 181/198; 181/175; 181/210; 181/284

[58] Field of Search ..... 181/200, 207, 208, 210, 181/224, 256, 295, 198, 175, 284; 14/1, 74

[56] References Cited

U.S. PATENT DOCUMENTS 3,881,569 5/1975 Evans, Jr. ..... 181/200

4,142,468 3/1979 Birnstiel ..... 181/210 X

*Primary Examiner*—Benjamin R. Fuller

*Attorney, Agent, or Firm*—Parkhurst & Oliff

[57] ABSTRACT

A structure for decreasing low frequency air vibrations, comprising a sound insulating floor, sound insulating sidewalls and a sound absorbing ceiling arranged so as to form an air chamber below and separate from the underside of an elevated road or railway bridge's traversed surface, thereby forming a space between the sound absorbing ceiling and the elevated bridge. The structure is very effective for decreasing the low frequency air vibration emanating from the structure of the elevated bridge and the low frequency air vibrations transmitted from the structural supports of the elevated bridge.

8 Claims, 12 Drawing Figures

STRUCTURE FOR DECREASING LOW FREQUENCY AIR VIBRATION

Background of the Invention (1) Field of the Invention:

The present invention relates to a structure for decreasing ultra-low frequency air vibration generated from an elevated bridge for road and railway due to the running of vehicles.

(2) Description of the Prior Art:

Noise in the ordinary audible range adversely effects the hearing sense and causes distress in an ordinary human body. However, low frequency vibration generated from an elevated bridge sometimes causes physiological disease when dealing with a particularly sensitive human body, even if the individual is located apart from the elevated bridge. Moreover, the low frequency vibration vibrates architectural structures which then generate secondary audible range noise or these vibration can cause displacement of moveable objects. In order to obviate these drawbacks, development of effective means for preventing low frequency air vibration has recently been demanded from the standpoint of improvement of the environment.

As a method for preventing the low frequency air vibration, there has been proposed a method, wherein the bottom surface of an elevated bridge is covered with a sound insulating material. However, in this method, the sound insulating material forms a new radiation plane due to the high permeability of low frequency air vibration, and the desired effect of decreasing the vibration has not substantially been attained. Furthermore, in order to increase the stiffness of an elevated bridge itself, there have been proposed methods, wherein an increased amount of steel is used in the beams or girders of the bridge. Also, a continuous paving of adjacent jointed sections has been performed, resulting in a unitary structure. However, none of these methods have resulted in a satisfactory effect. Moreover, since these methods are applied to an already existing elevated bridge, the methods have such drawbacks that the traffic must be cut off or controlled during these alterations.

Summary of the Invention

The object of the present invention is to obviate the above described drawbacks.

The feature of the present invention is the provision of a structure for decreasing low frequency air vibrations emanating from the underside of a road or railway elevated bridge, comprising a sound absorbing ceiling, sound insulating sidewalls and a sound insulating floor arranged so as to form an air chamber below and separate from the underside of an elevated bridge's traversed surface, surrounding the bridge's vertical support beams. The sound absorptionresonant vibration system, which is created below and separate from the elevated bridge, effectively reduces low frequency vibrations resulting from the traffic passing over the bridge.

Description of the Preferred Embodiment

The present invention is explained in more detail with reference to the following drawings.

Figure 1:
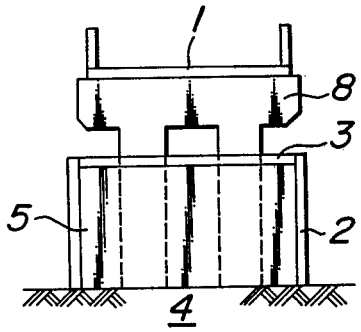
FIGS. 1, 2, 3 and 4 are diagrammatic sectional views of structures for decreasing low frequency air vibrations according to the present invention.

FIG. 1 illustrates one embodiment of the structure for decreasing low frequency air vibration according to the present invention. Referring to FIG. 1, sound insulating sidewalls 2 made of a material having a high density, such as reinforced concrete, steel plate, stone or the like, are uprightly arranged approximately underneath the outer edge of the elevated bridge, which comprises columns (legs) and a cross beam 8, and rests upon the ground thereunder. A sound absorbing ceiling 3, consisting mainly of porous inorganic sound absorbing material, inorganic fibrous sound absorbing material or the like, is arranged extendedly between the sound insulating sidewalls 2 at a location on the upper portion of the sidewalls, the exact location dependent upon the optimum air vibration absorbtion resulting in the most efficient sound absorptionresonant vibration system. That is, an air chamber 5 is formed of the sound absorbing ceiling 3, the sound insulating sidewalls 2 and a sound insulating floor 4, consisting of a sound insulating ground having a high density and a large weight, whereby a structure for decreasing low frequency air vibration illustrated in FIG. 1 is formed.

Figure 2:
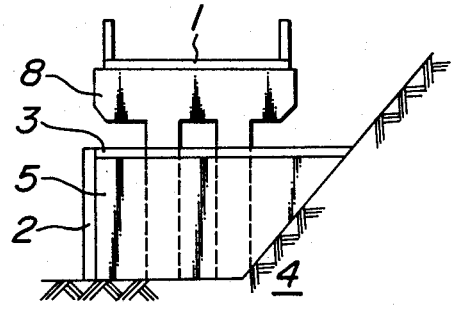
Figure 3:
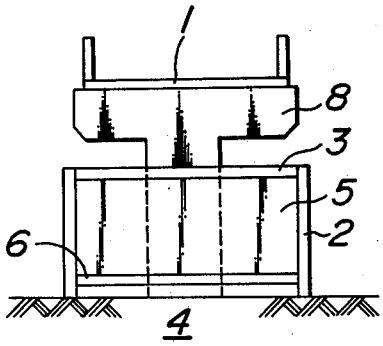
Figure 8:
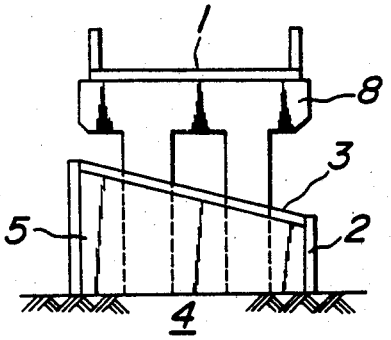
FIGS. 8 and 9 are diagramatical sectional views of structures for decreasing low frequency air vibrations according to the present invention.
Figure 9:
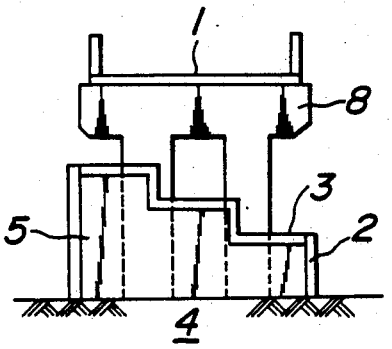

In the present invention, the sound absorbing ceiling 3 may be formed from a resonant plate or a resonant film which creates a damping effect on air propagated vibrations due to losses created by resonant vibration. When the ground is inclined as illustrated in FIG. 2, one of the sound insulating sidewalls may be replaced by the ground. Further, in order to widen the effected resonant vibration frequency range increasing the loss by resonant vibration in the sound the sound absorbing ceiling 3 may be inclined as shown in FIG. 8, or may be made of a plural number of stairs arranged stepwise as shown in FIG. 9; or a second sound insulating floor 6, consisting of reinforced concrete, stone of the like, can be arranged at the lower portion of the air chamber 5 in addition to the ground as illustrated in FIG. 3, whereby the air chamber 5 can be used as a garage or storehouse; or a second sound absorbing ceiling 7 can be arranged near the middle height of the air chamber in place of the sound insulating floor 6 as illustrated in FIG. 4.

Furthermore, when the upper edge of the sound insulating sidewall is projected upwardly beyond the surface of the sound absorbing ceiling and the projected portion is properly inclined towards the center of the elevated bridge (not shown), rainwater is prevented from being driven into the air chamber and air vibrations are prevented from radiating to the exterior of the air chamber.

Figure 4:
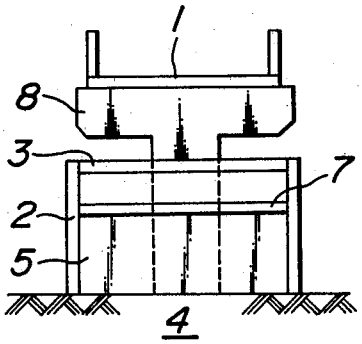
Figure 5A:
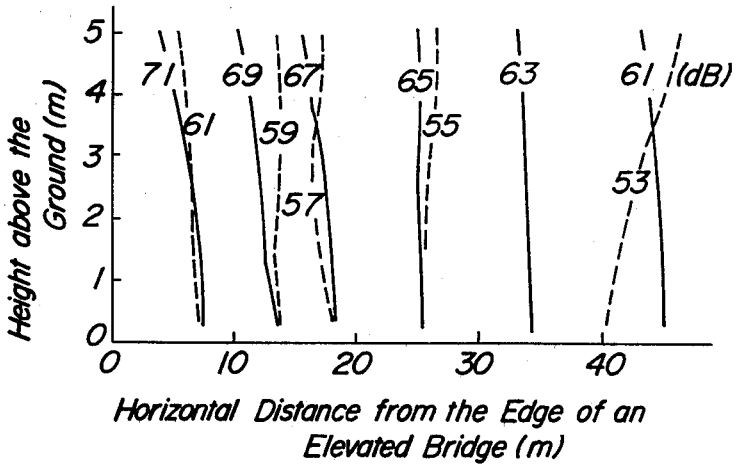
FIGS. 5A, 6A and 7A are graphs illustrating the distribution of vibration levels in relation to height above the ground and the horizontal distance from the edge of an elevated bridge at frequencies of 4 Hz, 12.5 Hz and 31.2 Hz respectively. Wherein the solid line indicates the vibration level without using any structure for decreasing low frequency air vibrations and the broken line indicates the vibration level after application of a structure for decreasing low frequency air vibrations in accordance with the present invention.
Figure 5B:
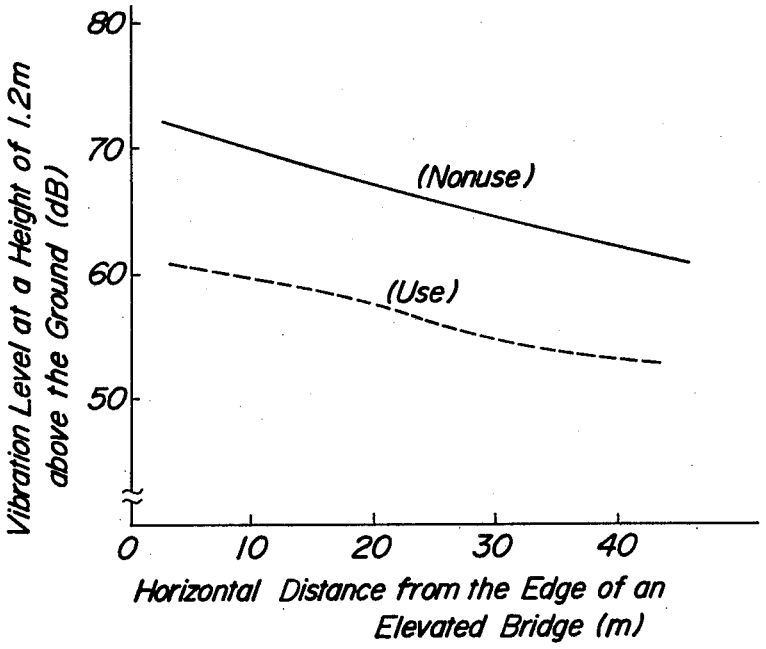
FIGS. 5B, 6B, and 7B are graphs illustrating the relationship between the horizontal distance from the edge of an elevated bridge and the vibration level at the height of 1.2 m above the ground at frequencies of 4 Hz, 12.5 Hz and 31.2 Hz respectively, wherein the solid line and the broken line have the same meanings as described above.
Figure 6A:
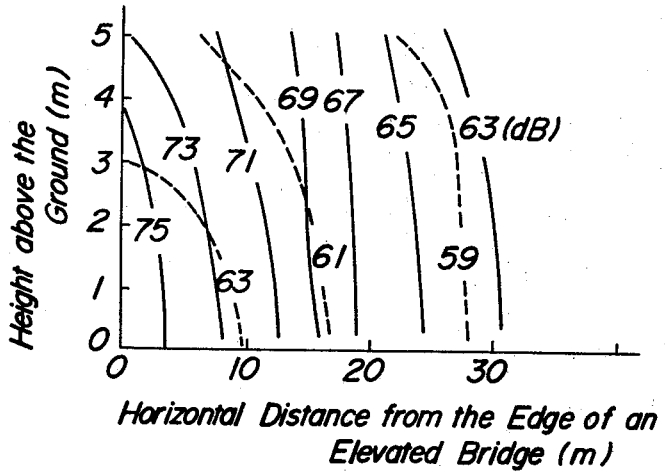
Figure 6B:
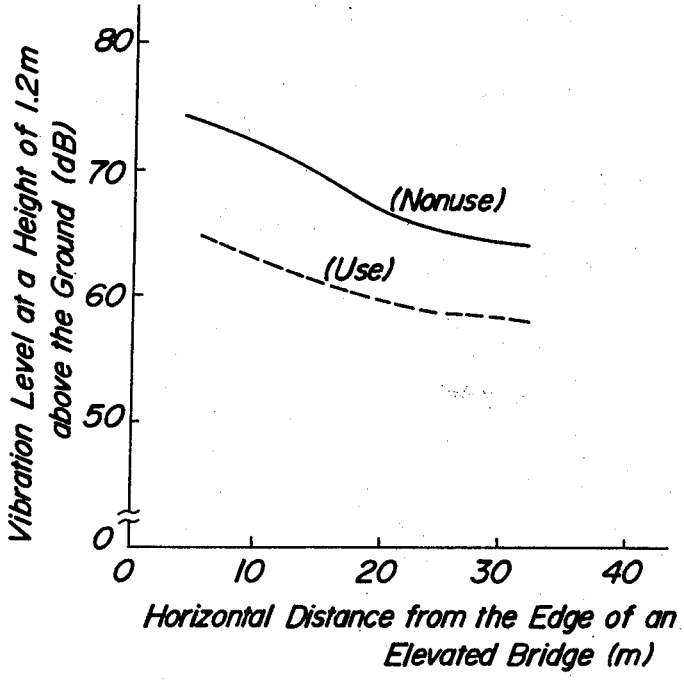
Figure 7A:
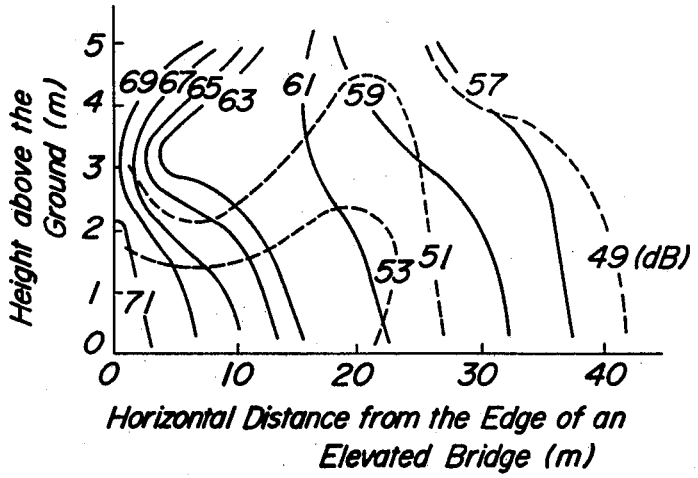
Figure 7B:
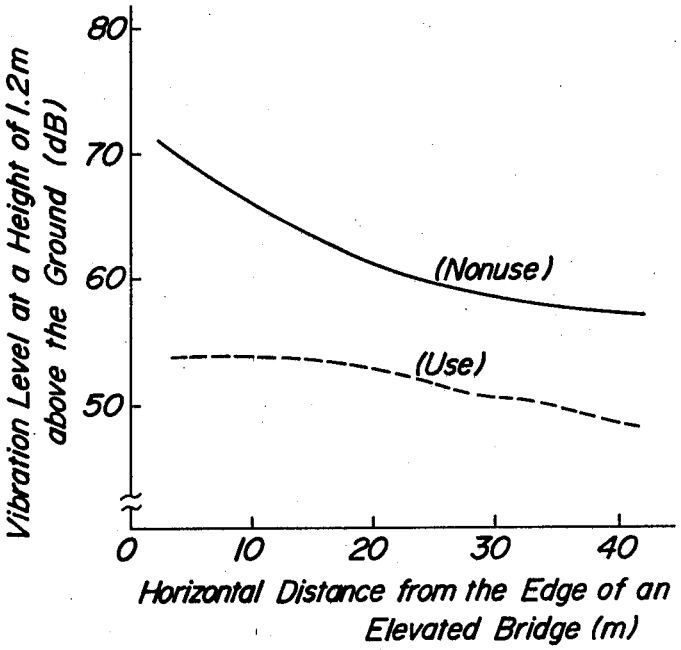

A comparison of the air vibrational levels when using of the structure for decreasing low frequency air vibrations, illustrated in FIG. 4, against the air vibrational levels without using any structure for decreasing low frequency air vibrations, is shown in FIGS. 5A–7B. It can be seen from FIGS. 5A–7B that the use of the structure for decreasing low frequency air vibration according to the present invention is remarkably effective. That is, through employment of this structure, a 5–10 dB lowering of the vibrational levels occurs at identical locations as shown in FIGS. 5B, 6B and 7B, by comparing the solid line (non-use of device) against the dotted line (use of device). Also, FIGS. 5A, 6A and 7A indicate that in order to achieve equivalent vibrational levels when comparing the use of the device (dotted lines) against the non use of the device (solid lines) one must be 20–50 meters horizontally closer to the bridge.

The conditions in the above described comparison was as follows: the elevated bridge 1 was made of a reinforced concrete having a road width of 20 m; the sound insulating sidewalls 2 were made of a reinforced concrete having a thickness of 200 mm; the sound absorbing ceilings 3 and 7 were made of a sound absorbing porous ceramic plate having a thickness of 20 mm; the distance between the bridging slab of the elevated bridge 1 and the sound absorbing ceiling 3 was 2 m; the distance between the sound absorbing ceiling 7 and the sound absorbing ceilng 3 was 2.5 m; and the distance between the sound absorbing ceiling 7 and the ground 4 was 6.5 m.

The present invention for decreasing low frequency air vibrations having the above described structure, the bridging slab, the sound absorbing ceiling and the air chamber, cooperate with each other to form a sound absorption-resonant vibration system located below and separate from the underside of the elevated bridge's traversed surface. Therefore, the low frequency air vibration energy radiating directly from the bridge is damped due to the losses by the viscosity and resonant vibration of the sound absorbing ceiling 3, and the air vibrations which penetrate the sound absorbing ceiling 3 are further damped by the sound absorption-resonant vibration chamber. In addition, sound waves which propagate down the elevated bridge supports and normally radiate into the air, are also damped by the sound absorption-resonant vibration chamber. As a result, the low frequency air vibrations at (some horizontal distance away) from the elevated bridge, are effectively decreased by the above described damping effect in combination with the sound insulating effect of the sound insulating sidewalls. Moreover, this structure can be constructed without subjecting the elevated bridge itself to any particular alterations and is useful for improving environment conditions. Therefore, the present invention contributes to the development of industry.

What is claimed is:

1. A structure for decreasing low frequency air vibrations emanating from the underside of an elevated bridge and from vertical structural supports for the elevated bridge, comprising a sound insulating floor, sound insulating sidewalls and a sound absorbing ceiling arranged so as to form an air chamber below and separate from the underside of an elevated bridge's traversed surface.

2. The structure of claim 1, wherein said chamber surrounds at least one of the bridge's vertical supports.

3. The structure of claim 1, wherein said chamber surrounds a plurality of the bridge's vertical supports.

4. The structure of claim 1, wherein at least one sidewall comprises natural earth.

5. The structure of claim 1, wherein said sound absorbing ceiling is inclined.

6. The structure of claim 1, wherein said sound absorbing ceiling is comprised of a plurality of stairs arranged in a stepwise manner.

7. The structure of claim 1, having a plurality of sound insulating floors.

8. The structure of claim 1, having a plurality of sound absorbing ceilings.

* * * * *